US007394011B2

(12) United States Patent
Huffman

(10) Patent No.: US 7,394,011 B2
(45) Date of Patent: Jul. 1, 2008

(54) MACHINE AND PROCESS FOR GENERATING MUSIC FROM USER-SPECIFIED CRITERIA

(76) Inventor: Eric Christopher Huffman, 1835 W. Cornelia Ave., Chicago, IL (US) 60657

( * ) Notice: Subject to any disclaimer, the term of this patent is extended or adjusted under 35 U.S.C. 154(b) by 249 days.

(21) Appl. No.: 11/037,400

(22) Filed: Jan. 18, 2005

(65) Prior Publication Data

US 2005/0223879 A1 Oct. 13, 2005

Related U.S. Application Data

(60) Provisional application No. 60/537,587, filed on Jan. 20, 2004.

(51) Int. Cl.
*G10H 7/00* (2006.01)

(52) U.S. Cl. ..... 84/612; 84/477 R; 84/609; 84/610; 84/615

(58) Field of Classification Search ..... 84/612, 84/609, 610, 477 R, 615
See application file for complete search history.

(56) References Cited

U.S. PATENT DOCUMENTS 5,300,725 A * 4/1994 Manabe ..... 84/609
5,315,911 A * 5/1994 Ochi ..... 84/477 R
5,455,378 A * 10/1995 Paulson et al. ..... 84/610
5,521,323 A * 5/1996 Paulson et al. ..... 84/610
5,587,546 A * 12/1996 Kato et al. ..... 84/609
5,615,876 A * 4/1997 Yergenson et al. ..... 271/258.01
5,679,913 A * 10/1997 Bruti et al. ..... 84/609
5,693,902 A * 12/1997 Hufford et al. ..... 84/650
6,072,113 A * 6/2000 Tohgi et al. ..... 84/470 R
6,096,961 A * 8/2000 Bruti et al. ..... 84/609
6,162,983 A * 12/2000 Takahashi ..... 84/615
6,166,316 A * 12/2000 Takahashi et al. ..... 84/619
6,201,176 B1 * 3/2001 Yourlo ..... 84/609
6,225,546 B1 * 5/2001 Kraft et al. ..... 84/609
6,313,387 B1 * 11/2001 Yamauchi ..... 84/609
6,392,135 B1 * 5/2002 Kitayama ..... 84/622
6,414,229 B1 * 7/2002 Gaudet ..... 84/465
6,414,231 B1 * 7/2002 Miyamoto et al. ..... 84/477 R
6,437,229 B1 * 8/2002 Nobumoto ..... 84/615
6,452,083 B2 * 9/2002 Pachet et al. ..... 84/609
6,528,715 B1 * 3/2003 Gargi ..... 84/615
6,548,747 B2 * 4/2003 Shibata et al. ..... 84/609
6,657,117 B2 * 12/2003 Weare et al. ..... 84/668
6,696,631 B2 * 2/2004 Smith et al. ..... 84/645

(Continued)

*Primary Examiner*—Lincoln Donovan
*Assistant Examiner*—Christina Russell
(74) *Attorney, Agent, or Firm*—White-Welker & Welker, LLC

(57) ABSTRACT

The present invention teaches a machine and process that generates music given a set of simple user-specified criteria. The present invention enables music generation wherein a user may specify the duration and tempo of the music to be generated that may then be played or stored for retrieval and use at a later time and does not require the user to be a skilled composer of music. The present invention allows the user to generate music in a very short period of time wherein the music generated by also has beginnings and endings that occur in a manner that is esthetically appropriate. In addition, transitions within the generated music occur in a manner that is esthetically appropriate. Music generated by the present invention also has unique qualities that are desirable to users that use music in their own products or works.

7 Claims, 6 Drawing Sheets

U.S. PATENT DOCUMENTS

| | | | | |
|---|---|---|---|---|
| 6,829,648 | B1 * | 12/2004 | Jones et al. | 709/230 |
| 6,888,999 | B2 * | 5/2005 | Herberger et al. | 386/65 |
| 7,022,905 | B1 * | 4/2006 | Hinman et al. | 84/609 |
| 7,078,607 | B2 * | 7/2006 | Alferness | 84/609 |
| 2002/0170415 | A1 * | 11/2002 | Hruska et al. | 84/609 |
| 2003/0167903 | A1 * | 9/2003 | Funaki | 84/477 R |
| 2004/0027369 | A1 * | 2/2004 | Kellock et al. | 345/716 |
| 2004/0049540 | A1 * | 3/2004 | Wood | 709/203 |
| 2004/0244565 | A1 * | 12/2004 | Cheng et al. | 84/610 |
| 2006/0080335 | A1 * | 4/2006 | Freeborg et al. | 707/100 |

* cited by examiner

MACHINE AND PROCESS FOR GENERATING MUSIC FROM USER-SPECIFIED CRITERIA

CROSS REFERENCE TO RELATED APPLICATIONS

This application claims priority from U.S. Provisional Patent Application Ser. No. 60/537,587, entitled "Machine and Process for Generating Music From User-Specified Criteria", filed on Jan. 20, 2004.

FEDERALLY SPONSORED RESEARCH

Not Applicable

REFERENCE TO MATERIAL SUBMITTED ON COMPACT DISC

This application claims reference to and hereby incorporates by reference in their entirety the material contained thereon the single compact disc submitted, and its duplicate, in IBM-PC machine format, compatible with MS-DOS, MS-Windows, and Unix operating systems, and containing the following three files: Generator_cpp1, 8 kb in size, created on May 31, 2005, Generator_h1, 5 kb in size, created on May 31, 2005, and Output_xml1, 42 kb in size, created on May 31, 2005.

TECHNICAL FIELD OF THE INVENTION

The present invention relates generally to music generating machines or processes. More specifically the present invention relates to a machine and process that generates music given a set of simple user-specified criteria.

PROGRAM APPENDIXES

Appendix A lists an example of the music structure 300;

Appendix B lists the music structure instance 340 that results from the [Music Sequence Generator Generates Music Structure Instance] step 240 when using the music structure 300 listed in Appendix A and with a duration of sixty seconds and tempo of 120 beats per minute;

Appendix C lists the music sequence, in human readable format that results from the [Music Sequence Generator Generates Music Sequence From Music Structure Instance] step 250 when using the music structure instance 340 listed in Appendix B;

Appendix D lists pseudocode comprising program headers necessary to explain the performance of each of the processes that make up the program of the preferred embodiment used by the system of the present invention;

Appendix E is a pseudocode listing comprising comments necessary to explain the performance of each of the processes that make up the program of the preferred embodiment used by the system of the present invention.

BACKGROUND OF THE INVENTION

Music is used in a variety of products and works. For example, music is often used in products such as web applications, computer games, and other interactive multimedia products. Music is also often used in other works such as television advertising, radio advertising, commercial films, corporate videos, and other media.

Working with music during the production of products and works that use music can be complicated and time consuming. For example, if the music in use is from a music library, it is of a fixed duration and tempo and therefore requires that the user of the music engage in the time consuming task of editing the music to alter it to fit the requirements of the product or work being produced.

If music is being produced by a composer of music, it is often the case that the producers of the product or work and the composer will engage in several time consuming iterations of producing the music and altering the music before the music fits the requirements of the product or work being produced.

If the music is being produced by a software application, such as those available in the present market that are designed to generate music for use in a product or work, it is often the case that the use of the software application is time consuming, requires extensive musical skill and knowledge, or is limited in it's ability to generate music that meets the requirements of the product or work being produced.

Music generating machines and processes have been invented in the past. Software applications exist that allow skilled composers of music to generate music. The Digital Performer™ software produced by Mark of the Unicorn, Inc. is an example of such software. Also, software applications exist that assist less-skilled composers in generating music. The Soundtrack software produced by Apple™ is an example of such software. Also, software applications exist that allow non-skilled users to generate music. The SmartSound™ Sonicfire™ Pro software produced by SmartSound Software, Inc. is an example of such software and is taught in U.S. Pat. No. 5,693,902.

The machines and processes like those noted above have several shortcomings. For example, a user of the machine or process must be a skilled composer of music. This excludes many users who need music but do not have the skills to generate it. A user of the machine or process must spend considerable time to generate the music. This excludes many users who need music but do not have the time required at their disposal. The machine or process is unable to generate music at user specified tempos. The machine or process is unable to generate music that has beginnings, endings, or transitions within the music that are esthetically appropriate.

The present invention is preferable over previous music generating machines or processes for several reasons. The present invention does not require the user to be a skilled composer of music. It allows the user to generate music in a very short period of time. The music generated is of the specified duration if the duration was specified by the user. The generated music is also of the specified tempo if the tempo was specified by the user.

The music generated by the present invention has a musical structure, which is a hierarchy of musical elements. These elements are assembled in a prioritized and sometimes temporally overlapping manner as a function of the user specified criteria. This manner of assembly results in generated music that is composed of sections appropriate for the beginning, middle, and ending of the music, as well as appropriate transitions between those sections. Such appropriate sections define "unique qualities" of the music produced and are referred to as "esthetically appropriate."

Thus, the music generated by the present invention has beginnings and endings, comprised of a hierarchy of unique elements that occur in a manner that is esthetically appropriate. In addition, transitions within and between the generated music elements occur in a manner that is esthetically appropriate as a result of appropriate transitions between those sections.

It is therefore an objective of the present invention to teach a machine and process that generates music given a set of simple user-specified criteria.

Another object of the present invention is to enable music generation wherein a user may specify the duration and tempo of the music to be generated that may then be played or stored for retrieval and use at a later time.

It is also an objective of the present invention that the music generated has unique qualities that are desirable to users that use music in their products or works. The generated music should be of the specified duration if the duration was specified by the user. Also, the generated music has esthetic qualities that are desirable to users that use music in their products or works. For example, the generated music has beginnings and endings that occur in a manner that is esthetically appropriate. In addition, transitions within the generated music occur in a manner that is esthetically appropriate.

SUMMARY OF THE INVENTION

In accordance with the present invention a method of a machine and process that generates music given a set of simple user-specified criteria is provided which overcomes the aforementioned problems of the prior art.

The present invention teaches a machine and process that generates music given a set of simple user-specified criteria. The present invention enables music generation wherein a user may specify the duration and tempo of the music to be generated that may then be played or stored for retrieval and use at a later time and does not require the user to be a skilled composer of music. The present invention allows the user to generate music in a very short period of time wherein the music generated by also has beginnings and endings that occur in a manner that is esthetically appropriate. In addition, transitions within the generated music occur in a manner that is esthetically appropriate. Music generated by the present invention also has unique qualities that are desirable to users that use music in their own products or works.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
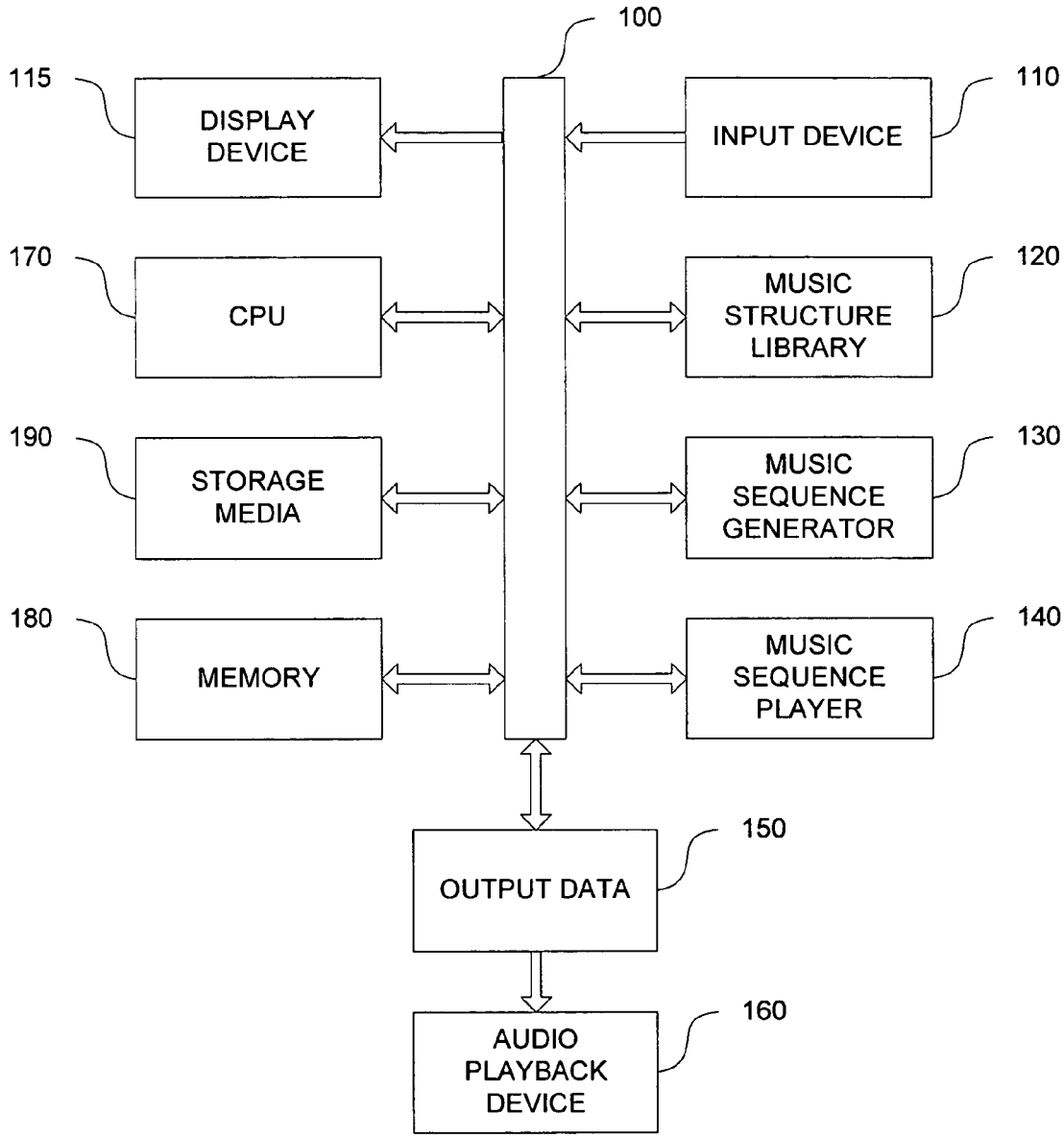
FIG. 1 is a diagram of the present invention's various components.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

Referring to the figures, it is possible to see the various major elements constituting the apparatus of the present invention. The invention is a computer-based system of interacting components. The major physical elements are: a buss 100 allows various components of the system to be connected or wired; an input device 110 such as a keyboard or mouse provides user input utilized by the system; a display device 115 such as a video card and computer screen provides the user with visual information about the system via a user interface; a CPU 170 of sufficient processing power handles the system's processing; a music structure library 120 contains data that is used by the system to generate music from the user-specified criteria; a music sequence generator 130 uses the data contained within the music structure library 120 to generate a music sequence; a music sequence player 140 uses the music sequence to produce an output data 150 that is in a format suitable for audio playback using an audio playback device 160 which allows for the user to listen to the music generated from the user-specified criteria; a storage media 190 stores the program steps for the system's processing, the music structure library 120, and the output data 150; and a memory 180 of sufficient size stores any data resulting from, or for, the system's processing.

Now referring to FIG. 1, the buss 100, CPU 170, storage media 190, memory 180, input device 110, and display device 115 will preferably be components of a computer. The audio playback device 160 may be a component of the computer but may also be a device external to the computer such as a digital to analog audio converter. The audio playback device 160 is preferably connected to other devices, such as an audio amplifier and speakers, which allow the user to listen to the music generated from the user-specified criteria. The output data 150 is in a format suitable for the audio playback device 160 to produce audio. The output data 150 format may be a sequence of floating point numbers representing multi-channel audio.

The buss 100, CPU 170, storage media 190, memory 180, input device 110, display device 115, output data 150, and audio playback device 160 are well-known components to those with ordinary skill in the electronic and mechanical arts.

The method or arrangement of wiring or connecting these components in a manner that is suitable for the operation of the system is also well known to those with ordinary skill in the electronic and mechanical arts.

The method by which the music structure library 120, the music sequence generator 130, and the music sequence player 140 operate to generate music from the user-specified criteria is described in detail later.

Music Structure Library

Figure 3:
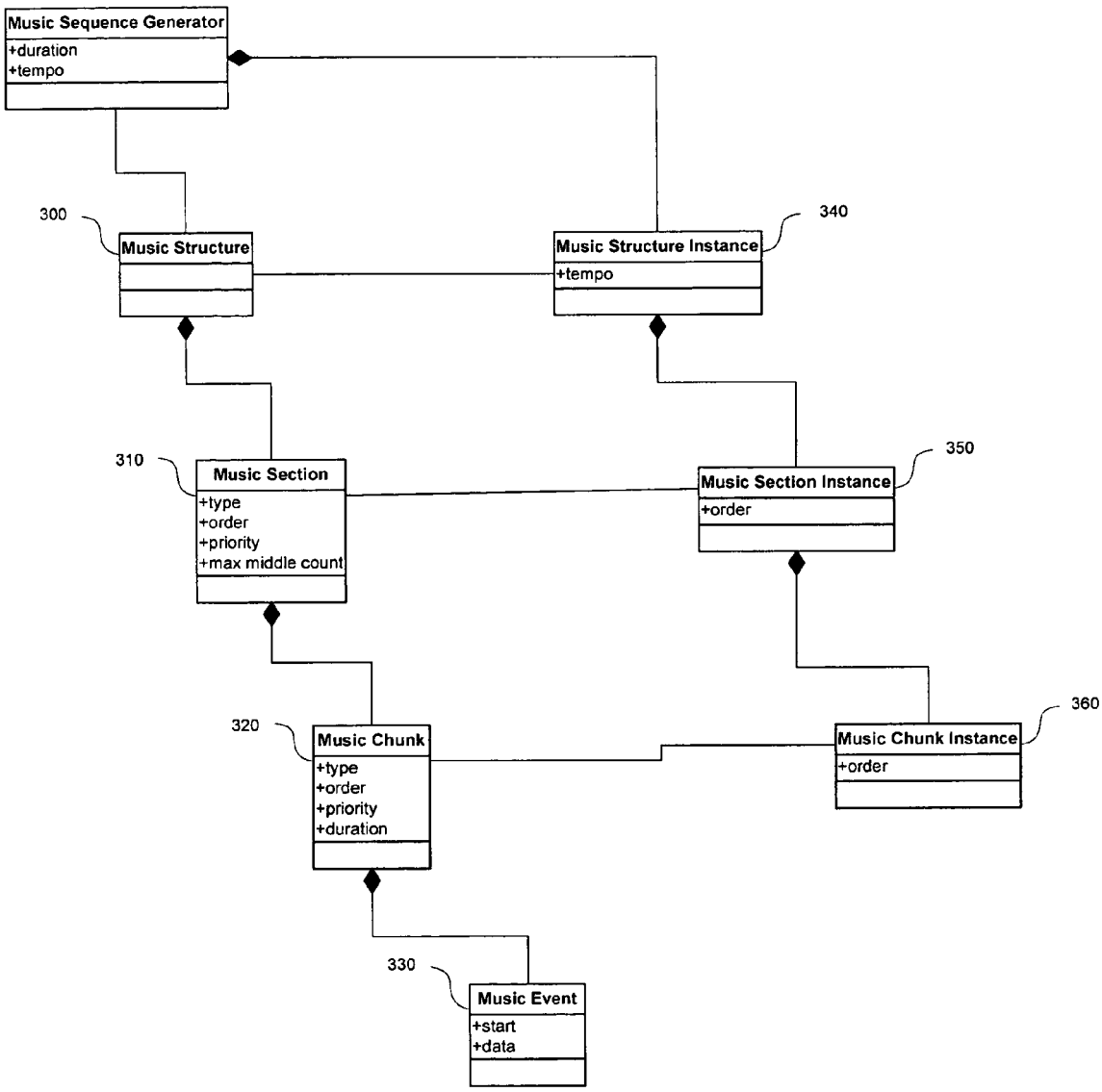
FIG. 3 is a diagram of the present invention's various data structures.

FIG. 3 is a diagram of a preferred embodiment for various data structures used by the system. A music structure 300 is a data structure that represents music in a manner that allows the system to generate music from the user-specified criteria. The music structure 300 may represent a musical entity such as a song. The music structure 300 can also represent an auditory, non-musical entity such as a sound effect.

The music structure 300 contains a plurality of music sections 310. The music section 310 represents sections or regions within the music structure 300. The music section 310 may represent sections of the song such as an intro, verse, chorus, or ending. The music section 310 may also represent an auditory but non-musical concept such as a build, peak, or decay of the sound effect.

The music section 310 contains a plurality of music chunks 320. The music chunk 320 represents chunks or regions within the music section 310. The music chunk 320 may represent measures or a musical phrase within the song. The music chunk 320 may also represent an auditory but non-musical concept such as an element of the sound effect (e.g. an initial crack of a thunder sound effect).

The music chunk 320 contains a plurality of music events 330. The music event 330 represents a single auditory event such as a musical note. The music event 330 may represent a single note of a musical instrument (e.g. g# played by a guitar). The music event 330 may also represent a chord played by the musical instrument. The music event 330 may also represent an audio sample (e.g. a dog bark).

Preferably, the music event 330 contains a data attribute that conforms to the MIDI (Musical Instrument Digital Interface) standard. The MIDI standard defines a note and the volume (velocity) at which the note is to be played. This allows for both note pitch and note velocity information to be transmitted to components incorporating tone generation means. The MIDI standard also allows for other types of data to be transmitted to such components, such as panning information that controls the stereo placement of a note in a left-to-right stereo field, program information that changes which instrument is playing, pitch bend information that controls a bending in pitch of the sound, and others. The MIDI standard also provides a way of representing an entire song or melody, a Standard MIDI File, which provides for multiple streams of MIDI data with timing information for each event.

The music structure library 120 contains a plurality of music structures 300. Preferably, the music structure library 120 is stored on the storage media 190 in the form of a computer file.

Music Structure Instance

A music structure instance 340 is a data structure that represents the usage of the music structure 300 to generate music that satisfies the user-specified criteria. The music structure instance 340 is like a description of how the music structure 300 may be used to generate music that satisfies the user-specified criteria. The music structure instance 340 has a reference to the music structure 300 it is associated with.

The music structure instance 340 contains a plurality of music section instances 350. The music section instance 350 represents a usage of the music section 310. The music section instance 350 may represent the usage of one of the sections of the song such as the intro, verse, chorus, or ending.

The music section instance 350 contains a plurality of music chunk instances 360. The music chunk instance 360 represents a usage of the music chunk 320. The music chunk instance 360 may represent the usage of measures or one of the musical phrases within the song.

The music sections 310 preferably have a type attribute. The music sections 310 type attribute may have one of the following values: begin, middle, or end. The music chunks 320 preferably have a type attribute. The music chunks 320 type attribute may have one of the following values: build, begin, middle, end, or decay.

A duration for the music chunk instance 360 is calculated in the following manner. If the music chunk instance 360 is contained in the first music section instance 350 of a sequence of music section instances 350 and the music chunk 320 type attribute value is equal to build, then the duration is equal to the referenced music chunk 320 duration attribute value. Otherwise, if the music chunk instance 360 is contained in the last music section instance 350 of a sequence of music section instances 350 and the music chunk 320 type attribute value is equal to end, then the duration is equal to the referenced music chunk 320 duration attribute value; or else, if the music chunk 320 type attribute value is equal to begin, middle, or end, then the duration is equal to the referenced music chunk 320 duration attribute value; otherwise, the duration value is zero.

Method Overview

Figure 2:
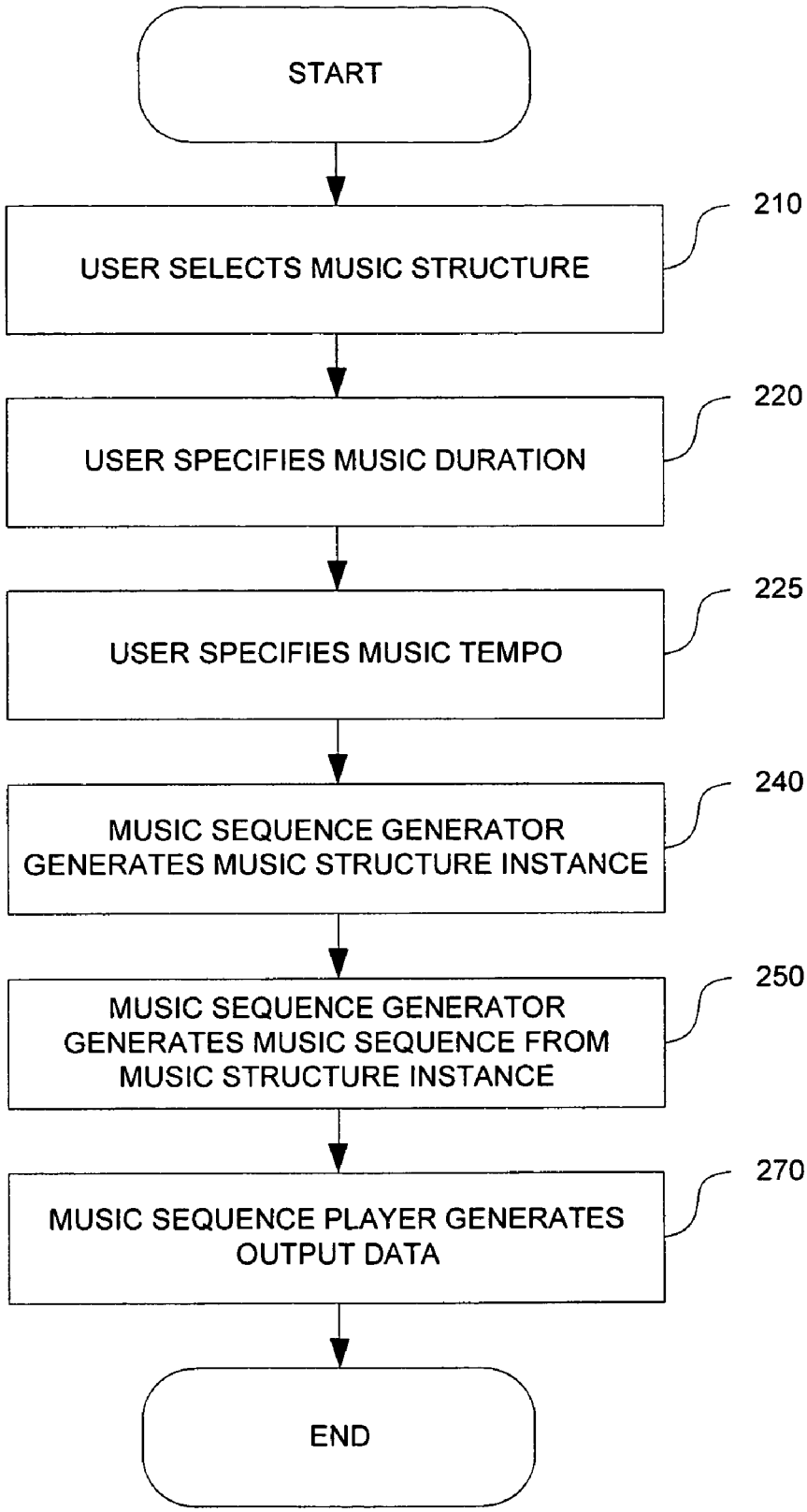
FIG. 2 is a flowchart indicating the present invention's various general steps for generating music.

Various steps, procedures, and routines in general shall be referred to in the following descriptions by a name enclosed with square brackets. The method of generating music from user-specified criteria can broadly be divided into several steps as illustrated in FIG. 2:

[User Selects Music Structure] step 210. In this step, the user selects one of the music structures 300 contained within the music structure library 120. Preferably, the music structures 300 are displayed on the display device 115 by the user interface and the user makes a selection through use of the input device 110.

[User Specifies Music Duration] step 220. In this step, the user specifies the duration of the music to be generated by the system. The duration is specified in seconds. Preferably, the duration is specified by the user through use of the user interface utilizing the display device 115 and the input device 110.

[User Specifies Music Tempo] step 225. In this step, the user specifies the tempo of the music to be generated by the system. The tempo is specified in beats per minute. Preferably, the tempo is specified by the user through use of the user interface utilizing the display device 115 and the input device 110.

[Music Sequence Generator Generates Music Structure Instance] step 240. In this step, the music sequence generator 130 uses the user-specified duration and tempo to generate the music structure instance 340 that represents the usage of the user-specified music structure 300 in a manner that satisfies the user-specified duration and tempo.

[Music Sequence Generator Generates Music Sequence From Music Structure Instance] step 250. In this step, the music sequence generator 130 uses the music structure instance 340 generated in the last step to generate the music sequence that satisfies the user-specified duration and tempo. Preferably, the format of the music sequence will be in the format of a Standard MIDI File.

[Music Sequence Player Generates Output Data] step 270. In this step, the music sequence player 140 uses the music sequence generated in the last step to generate the output data 150 which will either by played by the audio playback device 160 or saved to the storage media 190. Preferably, the music sequence is in the format of a Standard MIDI File and output data 150 may be produced by playing the music sequence with a MIDI sequencer and an associated sound bank. Preferably, the sound bank will be in DLS (Downloadable Sound Specification) format.

The DLS format is used to store both the digital sound data and articulation parameters needed to create one or more instruments. The instrument contains regions, which point to audio samples also embedded in the DLS format. Each region specifies a MIDI note and velocity range, which will trigger the corresponding sound and also contains articulation information such as envelopes and loop points.

The method of generating the output data 150 given the music sequence in Standard MIDI File format and the sound bank in DLS format is well known to those with ordinary skill in the software and audio engineering arts.

Step 240, Music Sequence Generator Generates Music Structure Instance

The music sequence generator 130 has a reference to the music structure 300 specified by the user in the [User Selects Music Structure] step 210. The music sequence generator 130 has a duration attribute and a tempo attribute. These attributes are set to the values specified by the user in the [User Specifies Music Duration] step 220 and the [User Specifies Music Tempo] step 225.

The music sequence generator 130 has a solution set which contains a plurality of music structure instances 340. These music structure instances 340 are generated by the music sequence generator 130 and are like a set of potential solutions, where each potential solution is considered for it's suitability to be the result of the [Music Sequence Generator Generates Music Structure Instance] step 240.

Figure 4:
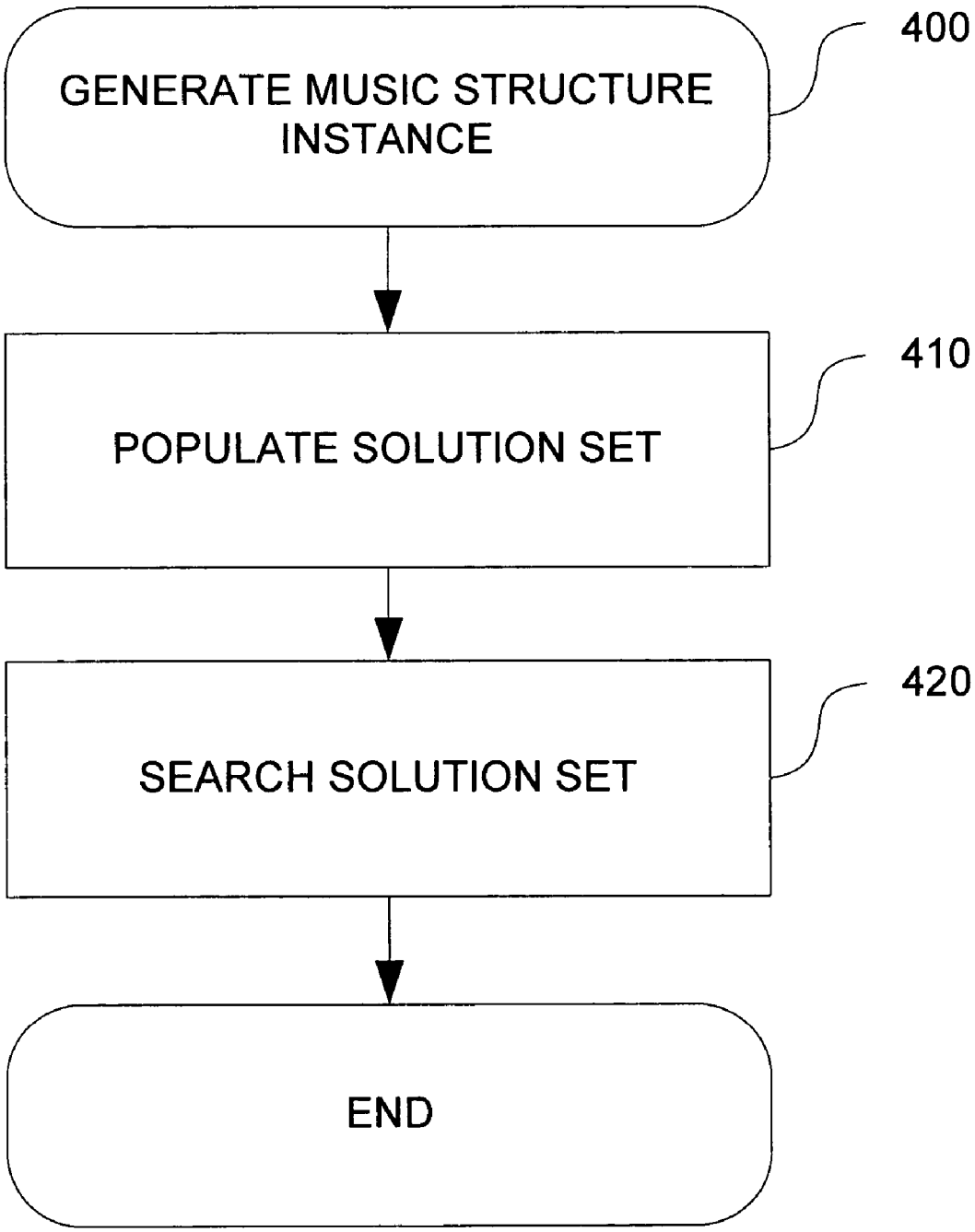
FIG. 4 is a flowchart indicating the present invention's various additional steps for generating music.

FIG. 4 shows the operation of a Generate Music Structure Instance routine 400. This routine generates the music structure instance 340 that is used as the result of the [Music Sequence Generator Generates Music Structure Instance] step 240.

The operation of the Generate Music Structure Instance routine 400 may be divided into several steps as illustrated in FIG. 4:

Populate Solution Set step 410. In this step, the music sequence generator 130 generates a plurality of music structure instances 340 that are contained within the solution set.

Search Solution Set step 420. In this step, the music sequence generator 130 searches the solution set for the music structure instance 340 that is the most suitable for satisfying the user-specified duration and tempo.

Populate Solution Set Step 410

Figure 5:
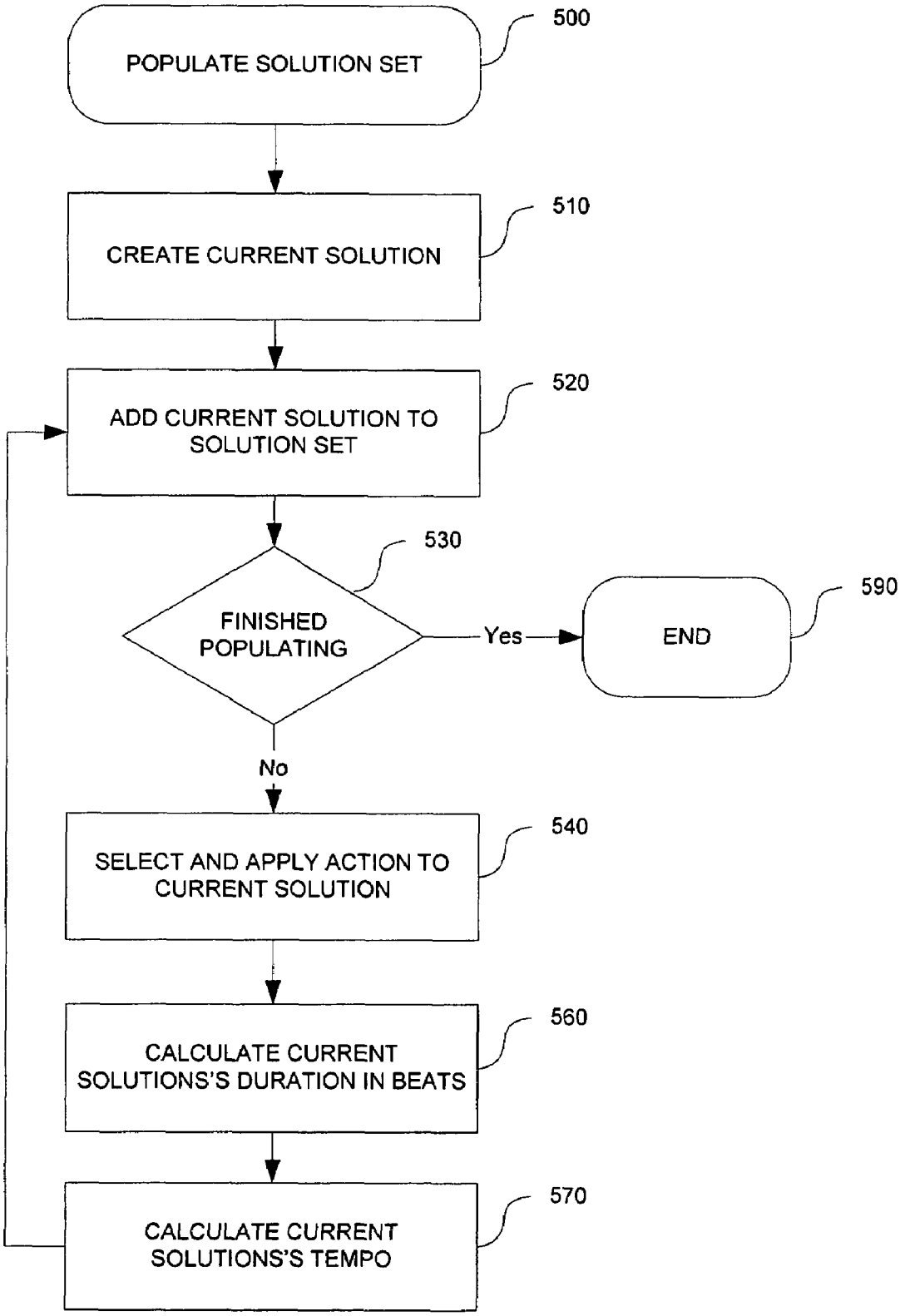
FIG. 5 is a flowchart also indicating the present invention's various additional steps for generating music.

FIG. 5 shows the operation of a Populate Solution Set routine 500 which may be used as the method of operation for the Populate Solution Set step 410. The operation of the Populate Solution Set routine 500 may be divided into several steps as illustrated in FIG. 5.

Create Current Solution step 510. In this step, a current solution is created. In this step, the current solution is an empty music structure instance 340 that contains zero music section instances 350. The music structure instance 340 has a tempo attribute, and the tempo attribute of the current solution is set to zero.

Add Current Solution To Solution Set step 520. In this step, the current solution is added to the solution set. Adding the current solution to the solution set is like making a copy of the current solution, which is then contained within the solution set.

Finished Populating step 530. In this step, a test is made to determine if the solution set has been sufficiently populated with music structure instances 340. If the test concludes that the solution set 500 has been sufficiently populated with music structure instances 340, the process will end 590, otherwise the routine will continue to Select and Apply Action To Current Solution step 540 until the solution set 500 has been sufficiently populated with music structure instances 340. Preferably, the solution set is determined to be sufficiently populated when a sufficient plurality of music structure instances 340 within the solution set have a tempo attribute value that is close to the user-specified tempo.

Select And Apply Action To Current Solution step 540. In this step, the current solution is examined by a plurality of music structure instance tests. The music structure instance test is associated with an action. The action is a routine that can modify a music structure instance 340, altering it in some manner. When the result of the music structure instance test is true, the action associated with the music structure instance test is applied to the current solution. Preferably, the action has logic that modifies the current solution in a manner that causes the current solution to better satisfy the user-specified duration and tempo.

Calculate Current Solution's Duration In Beats step 560. In this step, the current solution's duration in beats is calculated. An implementation of this step for the preferred embodiment is within the listing of Appendix E.

Calculate Current Solution's Tempo step 570. In this step, the current solution's tempo attribute is calculated and set. An implementation of this step for the preferred embodiment is within the listing of Appendix E.

Music Structure Instance Tests and Actions

The following is a description of various music structure instance tests and actions that may be used by [Select And Apply Action to Current Solution] step 540. The following description refers to various attributes of various data structure as shown in FIG. 3.

Test and Action A

In [Test and Action A] the music structure instance test is first performed. If the music structure instance test determines that the current solution contains zero music section instances 350, then the associated action is applied to the current solution.

The application of the associated action results in the current solution containing one new music section instance 350; the new music section instance 350 having a reference to one of the music sections 310 contained within the music structure 300 referenced by the current solution. The reference being to the music section 310 that has a priority attribute value; which is the greatest of priority attribute values for all music sections 310 contained within the music structure 300. The new music section instance 350 order attribute value is the same as the value of the referenced music section 310 order attribute and the new music section instance 350 containing zero music chunk instances 360.

Test and Action B

In [Test and Action B] the music structure instance test is first performed. If the music structure instance test determines that the current solution contains a non-minimal music section instance; where the non-minimal music section instance is the first music section instance 350 contained within the current solution that can be considered to be the non-minimal music section instance and where the music section instance 350 is considered to be the non-minimal section instance when the music section instance 350 does not contain music chunk instances 360 that reference music chunks 320 for each possible value of the music chunk 320 type attribute and where the music chucks 320 are contained within the music section 310 referenced by the music section instance 350. Then the associated action is applied to the current solution.

The application of the associated action results in the non-minimal music section instance containing one new music chunk instance 360, the new music chunk instance 360 having a reference to one of the music chunks 320 contained within the music section 310 referenced by the non-minimal music section instance. The reference being to the music chunk 320 that has a priority attribute value where the priority attribute value is greater than the priority attribute value for all other music chunks 320 referenced by the music chunk instances 360 contained within the non-minimal music section instance. The new music chunk instance 360 order attribute value being the same as the value of the referenced music chunk 320 order attribute.

Test and Action C

In [Test and Action C] the music structure instance test is first performed. If the music structure instance test determines that the current solution is a non-complete music structure instance where the non-complete music structure instance does not contain music section instances 350 that reference music sections 310 for each possible music section 310 contained within the music structure 300, then the associated action is applied to the current solution.

The application of the associated action results in the current solution containing one new music section instance 350, the new music section instance 350 having a reference to one of the music sections 310 contained within the music structure 300 referenced by the current solution, and the reference being to the music section 310 that has a priority attribute value. The priority attribute value is greater than the priority attribute value for all other music sections 310 referenced by the music section instances 350 contained within the current solution; and the new music section instance 350 order attribute value being the same as the value of the referenced music section 310 order attribute.

One of ordinary skill in the art would find it obvious that a number of various music structure instance tests and actions can be implemented and used in [Select And Apply Action to Current Solution] step 540. Details of music structure instance tests and actions are presented in Appendix E for the preferred embodiment of the invention.

SEARCH SOLUTION SET STEP 420

The Populate Solution Set step 410 results in the solution set containing a plurality of music structure instances 340. The result of the Search Solution Set step 420 is the music structure instance 340 that best satisfies the user-specified duration and tempo. A satisfactory music structure instance 340 is found by searching the solution set for the music structure instance 340 for which the tempo attribute value is closest to the user-specified tempo.

MUSIC SEQUENCE GENERATOR GENERATES MUSIC SEQUENCE FROM MUSIC STRUCTURE INSTANCE STEP 250

Figure 6:
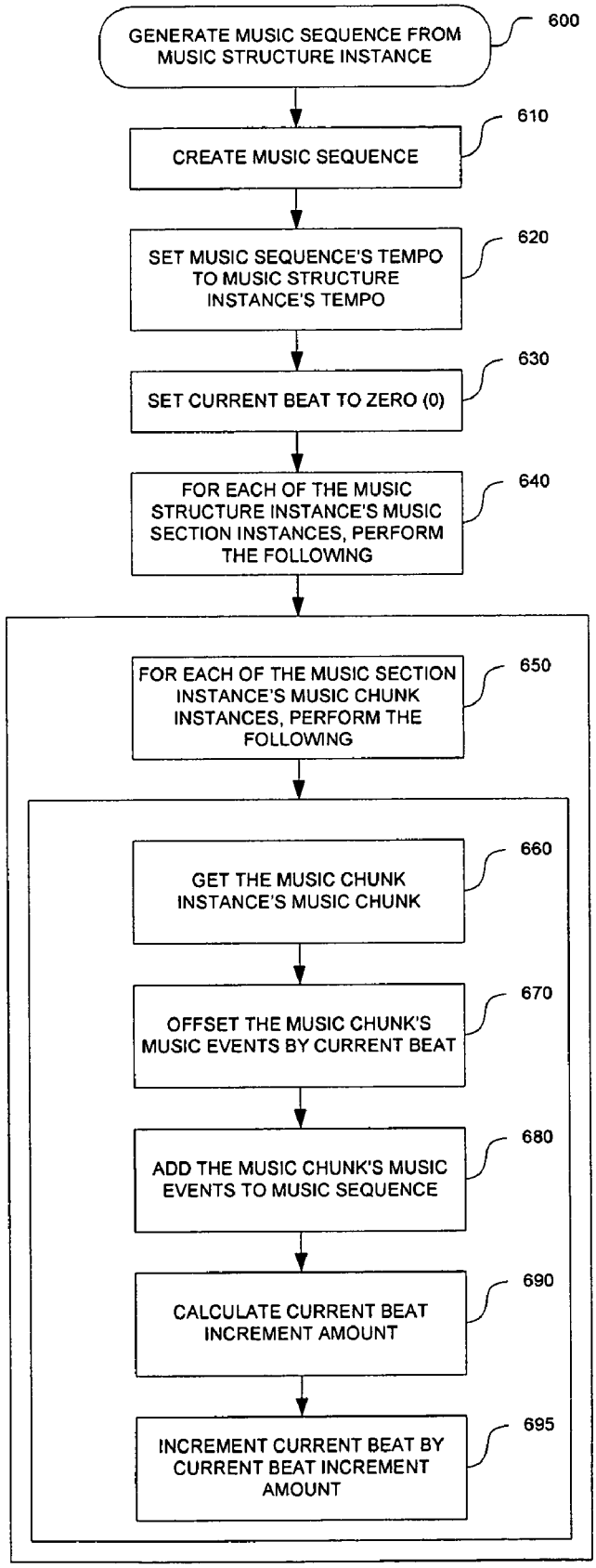
FIG. 6 is a flowchart also indicating the present invention's various additional steps for generating music.

FIG. 6 shows the operation of a Generate Music Sequence From Music Structure Instance routine 600 which may be used as the method of operation for the [Music Sequence Generator Generates Music Sequence From Music Structure Instance] Step 250. An implementation of this routine for the preferred embodiment is within the listing of Appendix E and is herein described.

The Generate Music Sequence From Music Structure Instance routine 600 starts with the creation of a music sequence in step 610. Next, the music sequence's tempo attribute value is set to the music structure instance's 340 tempo attribute value in step 620 and a current beat is set to zero in step 630.

In step 640, for each of the music section instances 350 contained within the music structure instance 340, a series of functions and steps are performed and repeated as necessary. In step 650, for each of the music chunk instances 360 contained within the music section instance 350, a series of functions and steps are performed and repeated as necessary.

In step 660, the music chunk 320 referenced by the music chunk instance 360 is obtained. Next, in step 670, the music events 330 contained within the music chunk 320 are offset by the current beat setting, then the music events 330 contained within the music chunk 320 are added to the music sequence in step 680. In step 690, a current beat increment amount is calculated. Finally, in step 695, the current beat is incremented by the current beat increment amount.

Appendix D lists pseudocode comprising program headers necessary to explain the performance of each of the processes that make up the program of the preferred embodiment used by the system of the present invention. Appendix E is a pseudocode listing comprising comments necessary to explain the performance of each of the processes that make up the program of the preferred embodiment used by the system of the present invention. The Appendix D and Appendix E listings will be easily implemented by those with ordinary skill in the software and audio engineering arts.

Appendix A lists an example of the music structure 300. Appendix B lists the music structure instance 340 that results from the [Music Sequence Generator Generates Music Structure Instance] step 240 when using the music structure 300 listed in Appendix A and with a duration of sixty seconds and tempo of 120 beats per minute. Appendix C lists the music sequence, in human readable format, that results from the [Music Sequence Generator Generates Music Sequence From Music Structure Instance] step 250 when using the music structure instance 340 listed in Appendix B.

The method of translation from the Appendix C listing to data in Standard MIDI File format will be well known to those with ordinary skill in the software and audio engineering arts.

Although the present invention has been described in detail with reference only to the presently preferred embodiments, those of ordinary skill in the art will appreciate that various modifications can be made without departing from the invention.

ALTERNATIVE EMBODIMENTS

There are many alternative ways that the present invention can be implemented, for example the user may specify a number of additional criteria (e.g. genre, mood, intensity, etc.) that may be used by the music structure instance tests and associated actions.

The data referenced by the music event 330 may be in different formats (e.g. MIDI, AIFF (Audio Interchange File Format), MOV (Apple™ QuickTime)).

The music structure library 120 may be located on a remote server computer that is accessed via a computer network from a local client computer.

The components of the present invention may be contained within a dedicated hardware device (e.g. a handheld music generating device).

The components of the present invention may be distributed over a computer network (e.g. the user may interact with the user interface on a client computer which communicates over the computer network with music generating components on a server computer).

The music structure 300, music section 310, music chunk 320, music event 330 hierarchy may be extended to be of any number of layers deep (i.e. the music structure 330 may be the root of a hierarchy of unlimited depth).

While the invention has been described in terms of several embodiments and illustrative figures, those skilled in the art will recognize that the invention is not limited to the embodiments or figures described. In particular, the invention can be practiced in several alternative embodiments that provides a machine and/or process for generating music, given a set of simple user-specified criteria.

Therefore, it should be understood that the method and apparatus of the invention can be practiced with modification and alteration within the spirit and scope of the appended claims. The description is thus to be regarded as illustrative instead of limiting on the invention.

The invention claimed is:

1. A method for generating music of a prescribed duration and tempo, comprising the steps of:

selecting a music structure contained within a music structure library;

specifying duration by an input device utilizing a display device;

specifying tempo by the input device utilizing the display device;

displaying the music structure library on the display device by a user interface;

selecting the music structure by the input device;

generating a music structure instance using said specified duration, said tempo and said selected music structure from a music sequence generator;

generating a music sequence using said music structure instance from the music sequence generator; and generating an output data from said generated music sequence, wherein the music structure instance is further comprised of a plurality of music section instances; and the music section instance is further comprised of a plurality of music chunk instances; and creating a current solution that is an empty music structure instance containing zero music section instances;

the current solution is added to a solution set for making a copy of the current solution that is then contained within the solution set;

a test is run to determine if the solution set has been sufficiently populated with music structure instances;

the test routine is repeated until the solution set has been sufficiently populated with music structure instances;

examining the current solution by a plurality of music structure instance tests and associated actions, that can modify a music structure instance to better satisfy the user-specified duration and tempo;

calculating the current solution's duration in beats; and calculating and setting the current solution's tempo.

2. The method for generating music of a prescribed duration and tempo of claim 1, additionally comprising the step of searching the solution set containing a plurality of music structure instances for the music structure instance for which the tempo and duration values best fit the specified values.

3. The method for generating music of a prescribed duration and tempo of claim 2, additionally comprising the search step of selecting a satisfactory music structure instance and then generating a music sequence from said selected satisfactory music structure instance.

4. The method for generating music of a prescribed duration and tempo of claim 1 wherein three tests are run to determine if the solution set has been sufficiently populated with music structure instances comprising the following test and actions:

Test and Action A the music structure instance test determines if the current solution contains zero music section instances, then associated action A is applied to the current solution;

associated action A results in the current solution containing one new music section instance;

Test and Action B the music structure instance test determines if the current solution contains a non-minimal music section instance, then the associated action is applied to the current solution;

associated action B results in the non-minimal music section instance containing one new music chunk instance; and Test and Action C the music structure instance test determines if the current solution is a non-complete music structure instance where the non-complete music structure instance does not contain music section instances that reference music sections for each possible music section contained within the music structure, then the associated action C is applied to the current solution;

application of the associated action C results in the current solution containing one new music section instance.

5. The method for generating music of a prescribed duration and tempo of claim 4, wherein, in Test and Action A, said new music section instance having a reference to the music section that has a priority attribute value, which is the greatest of priority attribute values for all music sections contained within the music structure; and said new music section instance order attribute value is the same as the value of the referenced music section order attribute and the new music section instance containing zero music chunk instances.

6. The method for generating music of a prescribed duration and tempo of claim 4 wherein, in Test and Action B, the new music chunk instance has a reference to one of the music chunks contained within the music section referenced by the non-minimal music section instance;

said reference being to the music chunk that has a priority attribute value where the priority attribute value is greater than the priority attribute value for all other music chunks referenced by the music chunk instances contained within the non-minimal music section instance; and said new music chunk instance order attribute value being the same as the value of the referenced music chunk order attribute.

7. The method for generating music of a prescribed duration and tempo of claim 4 wherein, in Test and Action C, the new music section instance has a reference to one of the music sections contained within the music structure referenced by the current solution;

the reference being to the music section that has a priority attribute value;

the priority attribute value is greater than the priority attribute value for all other music sections referenced by the music section instances contained within the current solution;

and the new music section instance order attribute value being the same as the value of the referenced music section order attribute.

* * * * *